United States Patent [19]

Dvorak et al.

[11] Patent Number: 4,728,107

[45] Date of Patent: Mar. 1, 1988

[54] BOARD GAME APPARATUS AND METHOD

[76] Inventors: Robert E. Dvorak, 7021 Date Palm Ave. S., Saint Petersburg, Fla. 33707; Richard D. Dvorak, 6250 Telegraph Rd. #5-04, Ventura, Calif. 93003

[21] Appl. No.: 869,000

[22] Filed: May 30, 1986

[51] Int. Cl.[4] ..... A63F 3/00

[52] U.S. Cl. ..... 273/273; 273/275; 273/290

[58] Field of Search ..... 273/273, 275, 278, 280 C, 273/288, 271, 290

[56] References Cited

U.S. PATENT DOCUMENTS

| | | | |
|---|---|---|---|
| 1,558,690 | 10/1925 | McCollum . | |
| 1,871,247 | 8/1932 | Trost . | |
| 2,162,876 | 6/1939 | Barton . | |
| 2,673,738 | 3/1954 | Jenkins | 273/256 |
| 3,649,023 | 3/1972 | Schohn . | |
| 4,019,746 | 4/1977 | Hare . | |
| 4,302,015 | 11/1981 | Bowser et al. | 273/271 |
| 4,488,727 | 12/1984 | Lam | 273/236 |

FOREIGN PATENT DOCUMENTS

| | | | |
|---|---|---|---|
| 979044 | 12/1975 | Canada | 273/275 |

OTHER PUBLICATIONS

Aquire (TM) games rules, board and playing pieces.

*Primary Examiner*—Anton O. Oechsle
*Attorney, Agent, or Firm*—Christensen, O'Connor, Johnson & Kindness

[57] ABSTRACT

A board game apparatus for playing a strategic and entertaining game. A game board and at least two types of playing pieces are provided. The game board is provided with a playing surface which displays a plurality of interconnected first symbols each of which displays a coded marking. Each coded marking is displayed on at least two first symbols on the game board. A plurality of first playing pieces are provided such that at least one first playing piece displays each code marked on a first symbol. Each of two or more players receives a set of distinguishable second playing pieces for placement on the first pieces he or she possesses on the game board. Each turn each player places at least one first playing piece on the game board at the first symbol of his or her choice marked with that same code. Players seek to position first playing pieces on first symbols sharing common boundaries, thereby creating chains. When a larger chain is connected to a smaller chain, the player possessing the larger chain gains total possession of the new chain. Thus selection of where to build chains, how to expand them and when to take over opponents' chains are key to increasing a player's possession of first symbols. The strategic dimensions can be further increased by providing third playing pieces that can be played on any turn in the place of a first playing piece. Third playing pieces can be positioned at any unoccupied first symbol and are used to block chain formations, as they occupy a first symbol but allow no player to gain possession of that first symbol and thereby connect a chain through it. The game is over when one player, the winner, has his or her second playing pieces positioned on first playing pieces occupying a majority of the first symbols displayed on the game board.

43 Claims, 14 Drawing Figures

BOARD GAME APPARATUS AND METHOD

FIELD OF THE INVENTION

This invention relates to board game apparatuses wherein playing pieces are positioned on a coded patterned game board.

BACKGROUND OF THE INVENTION

Games involving the positioning of playing pieces on patterned game boards are known and popular. Many such games involve aligning, encircling or connecting playing pieces in order to score points or otherwise meet a winning objective. Several of these games involve the positioning of coded playing pieces at correspondingly coded positions on the gam board. However, no game apparatuses have apparently been provided for games that require the player to select from a limited number of options which coded playing piece to position at one of multiple possible coded locations on the game board so as to create chains of connected pieces, expand chains, interconnect chains, protect chains from capture by opponents, or take over the chains of opponents.

SUMMARY OF THE INVENTION

The present invention provides a board game apparatus for playing a strategic and entertaining game. A game board and at least two types of playing pieces are provided. The game board is provided with a playing surface which displays a plurality of interconnected first symbols each of which displays a coded marking. Each coded marking is displayed on at least two first symbols on the game board. A plurality of first playing pieces are provided such that at least one first playing piece displays each code marked on a first symbol. Each of two or more players receives a set of distinguishable second playing pieces for placement on the first playing pieces he or she possesses on the game board. Each turn each player places at least one first playing piece on the game board at the first symbol of his or her choice marked with that same code. Players seek to position first playing pieces on first symbols sharing common boundaries, thereby creating chains. When a larger chain is connected to a smaller chain, the player possessing the larger chain gains total possession of the new chain. Thus selection of where to build chains, how to expand them and when to take over opponents' chains are key to increasing a player's possession of first symbols. The strategic dimensions can be further increased by providing third playing pieces that can be played on any turn in the place of a first playing piece. Third playing pieces can be positioned at any unoccupied first symbol and are used to block chain formations, as they occupy a first symbol but allow no player to gain possession of that first symbol and thereby connect a chain through it. The game is over when one player, the winner, has his or her second playing pieces positioned on first playing pieces occupying a majority of the first symbols displayed on the game board.

DESCRIPTION OF THE PREFERRED EMBODIMENT

Figure 1:
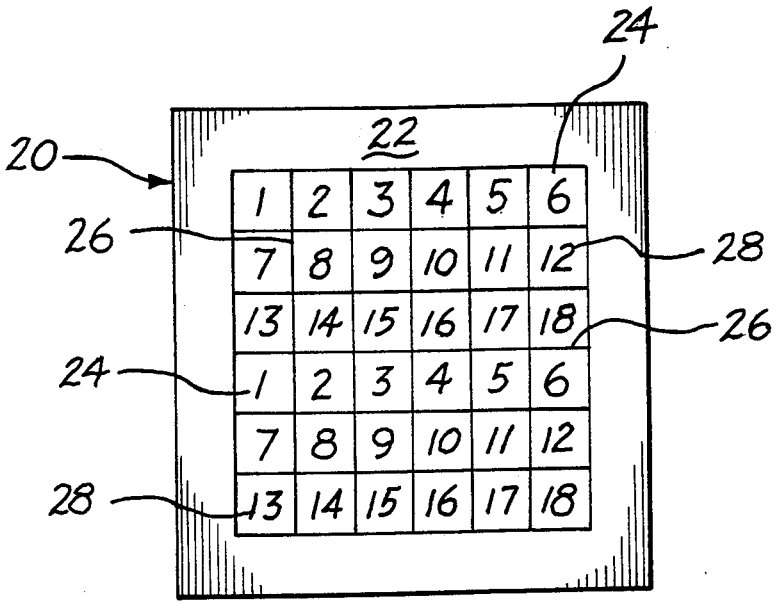
FIG. 1 is a plan view of a game board upon which first symbols are directly interconnected.

Referring to FIG. 1, a game board 20 is provided with a playing surface 22 upon which interconnected first symbols 24, such as the squares shown here, are printed or otherwise displayed. A plurality of the first symbols 24 are positioned in nonoverlapping arrangement over the playing surface 22. The first symbols 24 can be directly interconnected, as shown, meaning that each first symbol 24 is positioned so as to contiguously border, by sharing a mutual boundary 26, at least one other first symbol 24. The first symbols 24 display coded first indicia 28. Each coded first indicium 28 is displayed on at least two of the first symbols 24 on the playing surface 22. By way of illustration, thirty-six first symbols 24 are shown, each of which displays one of eighteen different Arabic numerals that serve as coded first indicia 28. Here, each of the eighteen numerals 28 is displayed on two of the first symbols 24.

Figure 2:
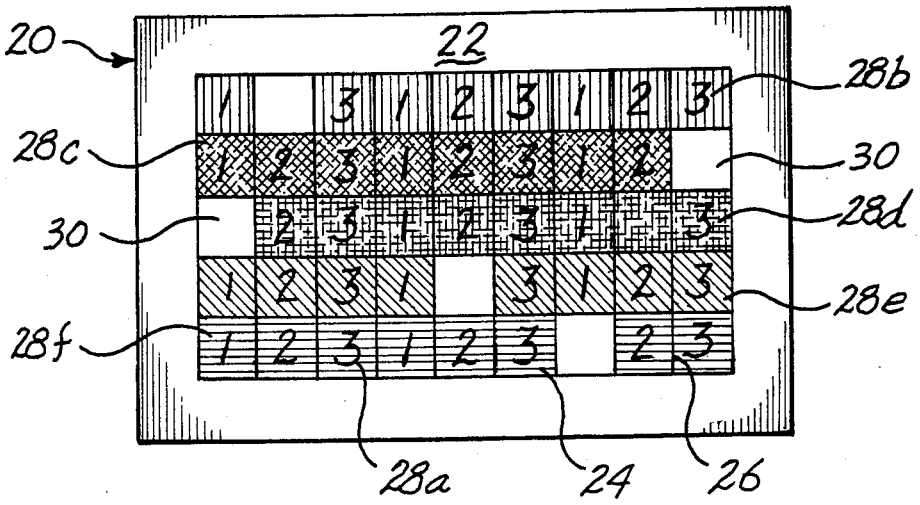
FIG. 2 is a plan view of a game board as in FIG. 1 except with a greater number of first symbols some of which are indirectly connected by second symbols.

FIG. 2 shows a game board 20 on which some of the first symbols 24 are indirectly connected through second symbols 30. Here, each first symbol 24 is positioned to contiguously border at least two other symbols, at least one of which is another first symbol 24. The first and second symbols 24, 30 are distinguishable one type from the other by an absence of first indicia 28 on the second symbols 30. For example, forty first symbols 24 and five second symbols 30 are shown displayed on this playing surface 22. Each first symbol 24 displays a coded first indicium 28 which is this embodiment takes the form of one of three Arabic numerals 28*a* combined with one of five color-coded pigments: red 28*b*, orange 28*c*, yellow 28*d*, green 28*e*, or blue 28*f*. Each of the resulting fifteen distinguishably coded first indicia 28 is displayed on the playing surface 22 at two or more first symbols 24. The second symbols 30 lack corresponding pigmentation 28*b–f* and furthermore are not marked with Arabic numerals 28*a*, and so are collectively distinguished from the various first symbols 24.

Figure 3:
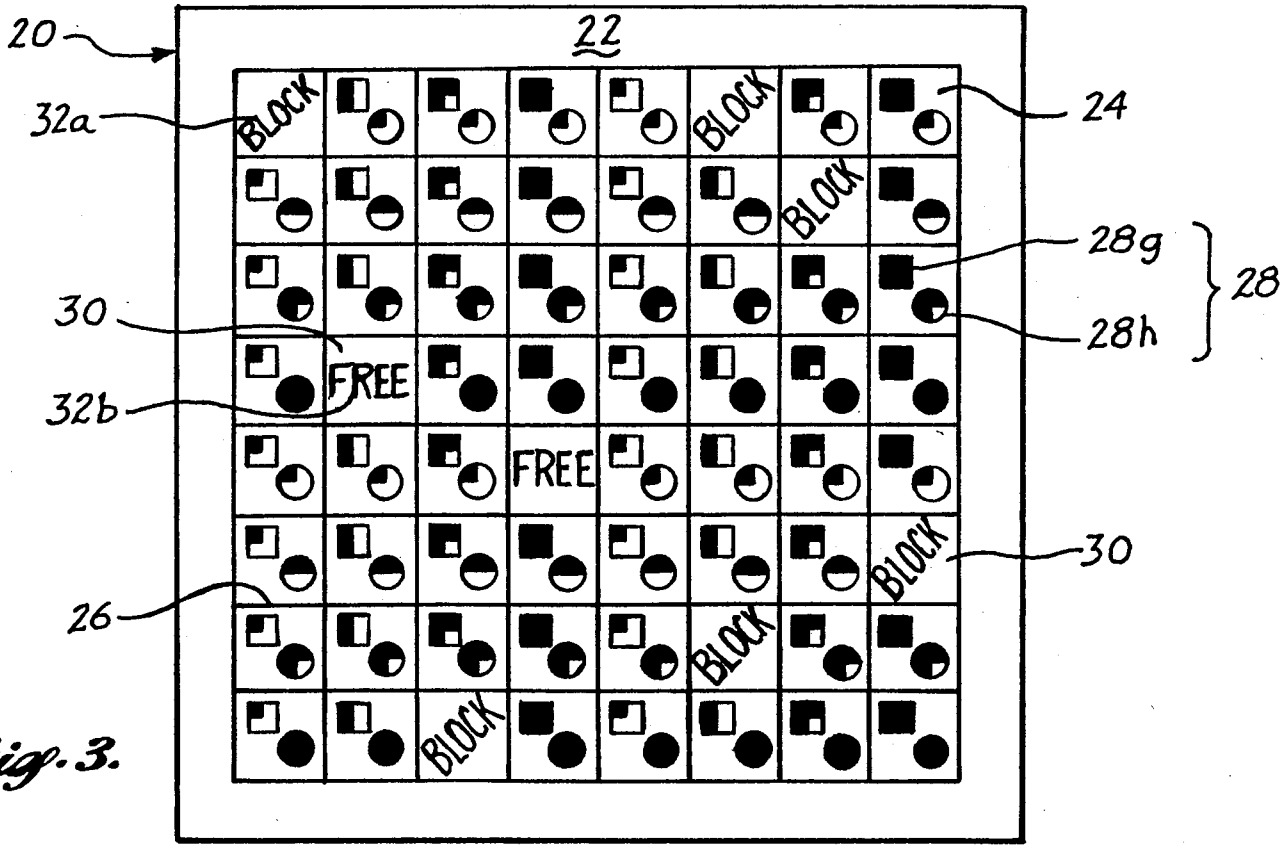
FIG. 3 is a plan view of a game board as in FIG. 2 with a greater number of symbols and two types of second symbols.

Referring to FIG. 3, the second symbols 30 may display coded second indicia 32 made up of any color, number or symbol code not displayed on the first symbols 24. In this particular embodiment each of eight second symbols 30 displays one of two different words ("BLOCK" or "FREE") that serve as coded second indicia 32. Six of the second symbols 30 display one of the words 32*a*, and two 30 display the other word 32*b*. Here each of the first symbols 24 displays a coded first indicium 28 made up of some combination of two geometric shapes 28*g*, 28*h*. Each of the resulting sixteen first indicia 28 is displayed on three or more of the first symbols 24.

Figure 4:
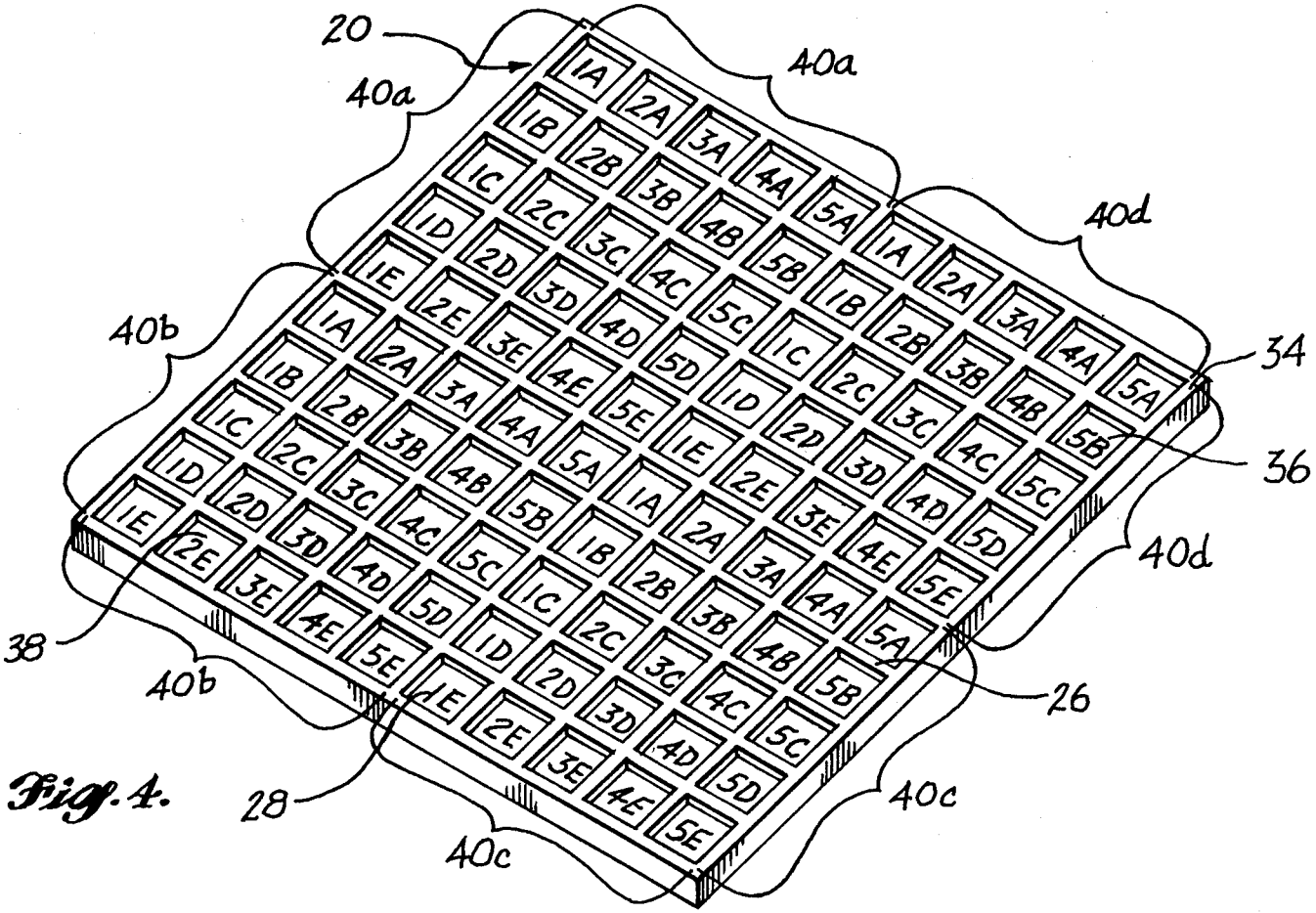
FIG. 4 is an isometric view of a game board as in FIG. 3 with a greater number of symbols and where each symbol is recessed into the game board.

Referring to FIG. 4, the game board 20 can be threedimensionally configured of plastic or wood with an upper surface 34 and a playing surface 22 in the form of an array of shallow recesses 36. The recesses 36 are separated by raised boundaries 26 that interconnect to form the upper surface 34. Each recess 36 shares a mutual boundary 26 with two or more other recesses 36. Each recess 36 serves as a first or second symbol 24, 30, as determined by any coded indicium 28, 32 displayed thereon. In the representative embodiment shown here, each of one hundred square recesses 36 displays a first indicium 28, in this case an alphanumeric code, and so serves as a first symbol 24. Each of twenty-five first indicia 28 is displayed on one first symbol 24 in each of the four quadrants 40*a–d* of playing surface 22. No second symbols 30 are shown.

Figure 5:
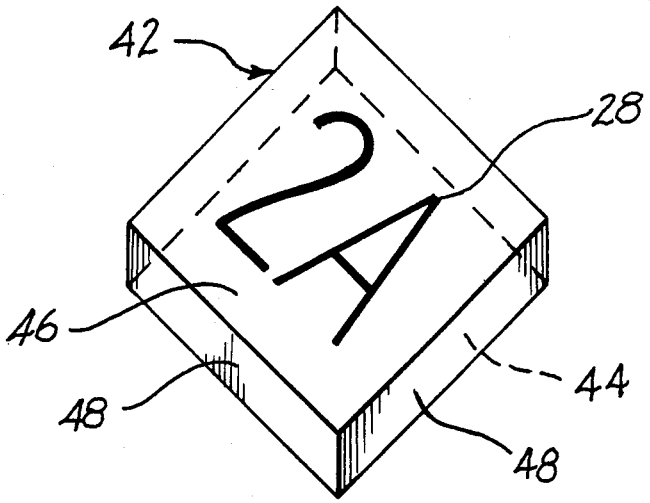
FIG. 5 is a partial sectional view of a first playing piece.

Referring now to FIG. 5, a plurality of first playing pieces 42 are provided with the game board 20 described above. Each first playing piece 42 has a lower surface 44 that is adapted for reversible placement on the playing surface 22 at any first symbol 24. An upper surface 46 displays any one of the first indicia 28 that are correspondingly displayed on the first symbols 24. The lower surfaces 44 of the various first playing pieces 42 are typically indistinguishable from one another but are distinguishable from the upper surfaces 46 by an absence of first indicia 28 on the lower surfaces 44. The upper surface 46 may be configured for face down placement on a flat surface. Side surfaces 48 may be adapted for freestanding the first playing piece 42 on a flat surface or for placement on a rack (now shown). For example, this first playing pieces 42 is in the form of a right prism with flat lower and upper surfaces 44, 46. The flat side surfaces 48 are sufficiently wide so as to serve as a base for freestanding the piece 42 on edge. Its upper surface 46 displays a first indicium 28 corresponding to one displayed by four of the first symbols 24 on the game board 20 shown in FIG. 4. Such first playing pieces 42 can be configured with outside dimensions slightly less than those of the recessess 36 shown in FIG. 4.

Figure 6:
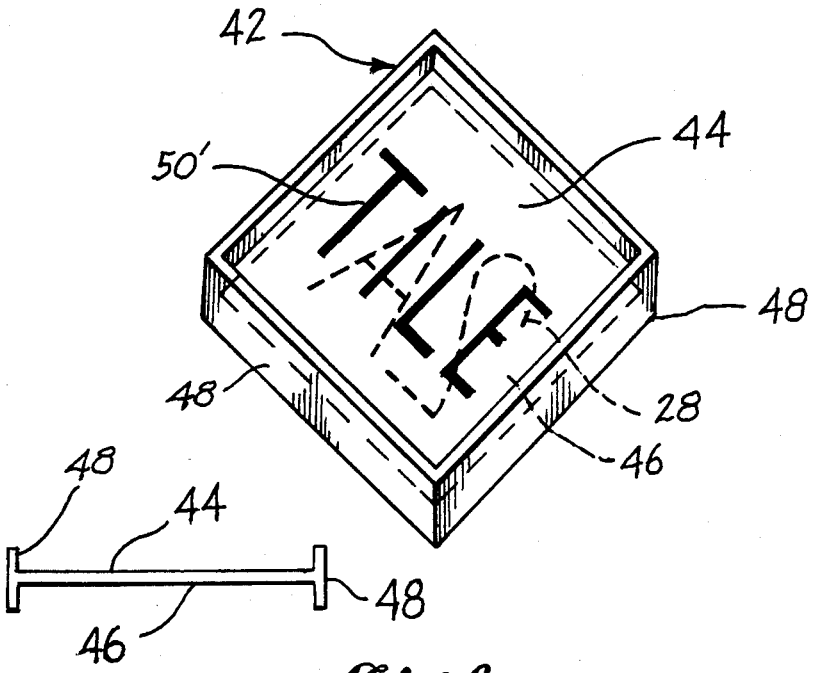
FIG. 6 is a partial sectional view and a cross-sectional view of a first playing piece as in FIG. 5 except displaying third indicia and with projecting side surfaces.

Referring to FIG. 6, the lower surfaces 44 of the first playing pieces 42 can display a logo or descriptive third indicium 50 that is not displayed on the playing surface 22. For example, this lower surface 44 displays a word "TILE" that serves as a third indicium 50. The flat upper and lower surfaces 46, 44 of this particular first playing piece 42 are flat, with the side surfaces 48 projecting perpendicular above and below the upper and lower surfaces 46, 44.

In a preferred embodiment the number of first playing pieces 42 that are provided is equal to the number of first symbols 24 displayed on the game board 20. Of that total, first playing pieces 42 displaying each first indicium 28 are provided in exact correspondence to the number of first symbols 24 correspondingly displaying an identical first indicium 28. For example, in combination with the game board 20 shown in FIG. 4 a total of one hundred first playing pieces 42 are preferably provided, with four of the provided first playing pieces 42 displaying each one of the twenty-five first indicia 28 shown on the first symbols 24.

Figure 7:
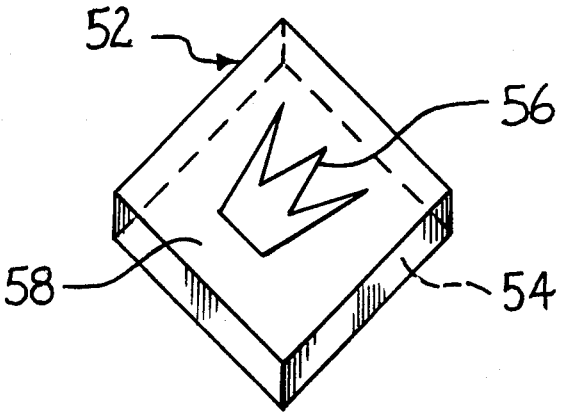
FIG. 7 is a partial sectional view of a second playing piece.

Referring now to FIG. 7, a plurality of second playing pieces 52 are also provided with the game board 20 and first playing pieces 42. Each second playing piece 52 has a lower surface 54 that is adapted for reversible placement on the upper surface 46 of any of the first playing pieces 42. The second playing pieces 52 may otherwise be configured substantially like the first playing pieces 42. First and second playing pieces 42, 52 are distinguished one type from the other by an absence of first and third indicia 28, 50 on the second playing pieces 52. Second playing pieces 52 are further characterized and distinguished from the first playing pieces 42 by the display of coded fourth indicia 56 on the second playing pieces 52. For example, the upper surface 58 of the second playing piece 52 shown in this view displays a geometric symbol that serves as a fourth indicium 56.

Figure 8:
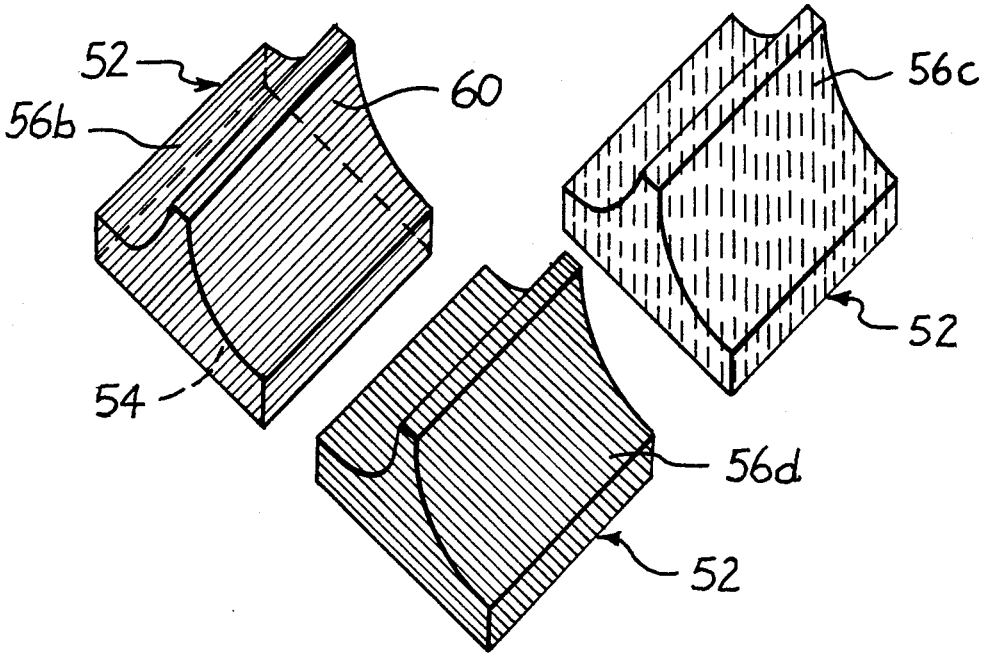
FIG. 8 is a partial sectional view of three second playing pieces as in FIG. 7 except with an apex that is developed into a manipulable handle.

Referring to FIG. 8, the upper surface 58 of the second playing pieces 52 can be developed into an apex 60 that serves as a manipulable handle. The lower surface 54 of each piece 52 shown in this view is flat and may be configured of dimensions to fit within the recessed upper surface 46 of the first playing piece 42 shown in FIG. 6. These second playing pieces 52 are pigmented to display as fourth indicia 56 colors that do not correspond with any of the first indicia 28 used on the other game components 20, 42. For example, these particular second playing pieces 52 are pigmented brown 56*b*, violet 56*c*, or green 56*d*, none of which colors can be displayed above as a first indicium 28 on a first symbol 24 or correspondingly coded first playing piece 42.

In a preferred embodiment the minimum number of second playing pieces 52 that are provided displaying each distinguishable fourth indicium 56 is equal to the smallest whole number that is a majority of the number of first symbols 24 displayed on the game board 20. For example, with the game board 20 shown in FIG. 4 second playing pieces 52 displaying the three fourth indicia 56*b–d* shown in FIG. 9 are provided in the following minimum quantities: fifty-one brown 56*b*, fifty-one violet 56*c* and fifty-one green 56*d*, for a total of one hundred and fifty-three second playing pieces 52.

Figure 9:
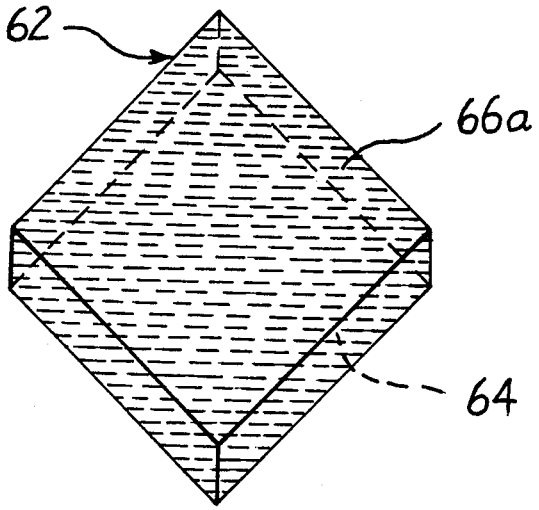
FIG. 9 is a partial sectional view of a third playing piece.

Referring now to FIG. 9, a plurality of third playing pieces 62 may also be provided. Each third playing piece 62 has a lower surface 64, like that 44 of the first playing pieces 42, that is adapted for reversible placement on the playing surface 22 at a selected first symbol 24. Third playing pieces 62 are collectively distinguishable from first and second playing pieces 42, 52 by an absence of first, third, and fourth indicia 28, 50, 56 on the third playing pieces 62. The third playing pieces 62 may distinctively display one or more fifth indicia 66. For example, a distinctive pigment, e.g., grey, which is not otherwise utilized as a first, third, or fourth indicium 28, 50, 56, can be used as a fifth indicium 66 to further distinguish the third playing pieces 62 collectively from the first and second playing pieces 42, 52.

Figure 10:
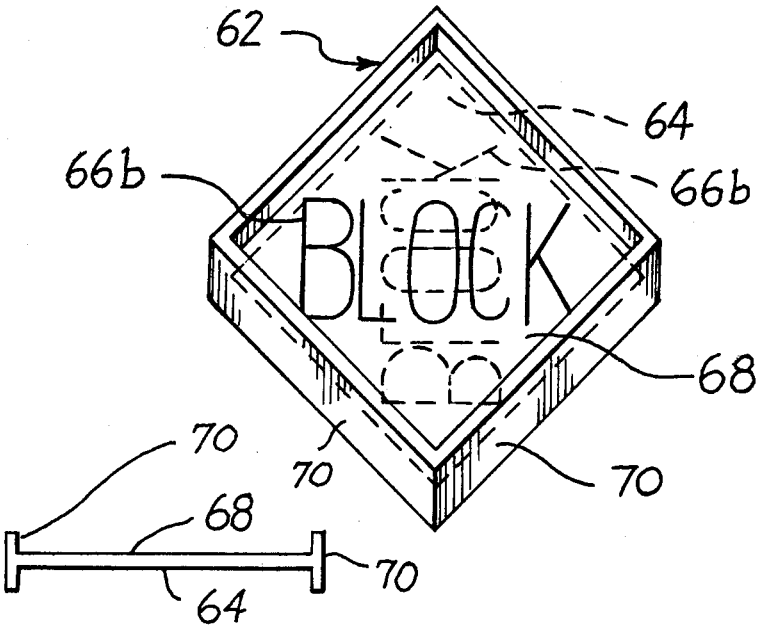
FIG. 10 is a partial sectional view and a cross-sectional view of a third playing piece as in FIG. 9 except with projecting side surfaces.

Coded fifth indicia 66 may alternatively be displayed on the third playing pieces 62, in order to individually distinguish one or a group of the third playing pieces 62 from the others 62. Such coded fifth indicia 66 may correspond with coded second indicia 32 displayed on second symbols 30 on the game board 20. For example, FIG. 10 shows a third playing piece 62 displaying a coded fifth indicium 66 in the form of a word "BLOCK" which corresponds with one of the coded second indicia 32 displayed on the second symbols 30 shown in FIG. 3. Here the word that serves as the fifth indicium 66 is displayed on both the upper and lower surfaces 68, 64 of the third playing pieces 62. This third playing piece 62 is otherwise configured like the first playing piece 42 shown in FIG. 6.

In a preferred embodiment third playing pieces 62 are provided in a number equal to four times the number of different fourth indicia 56 displayed on the second playing pieces 52. For example, if there are three fourth indicia **56*b–d*, as indicated in FIG. 8, then twelve third playing pieces 62** are provided in the subject game apparatus.

With the game apparatus provided in combination like described above, and preferably with the components described with reference to FIGS. 4, 5, 8 and 10, the novel game is ready for play. The object of the game is to be the first player to occupy a majority of the first symbols 24 displayed on the playing surface 22 of game board 20, that is, the first player to position all of his or her second playing pieces 52 upon first playing pieces 42 positioned on the playing surface 22.

A simple embodiment of this game can be played by two or more players. For the sake of description, this representative game play will be described with reference to the game board 20 shown in FIG. 4. The game board 20 is set up as follows. The first playing pieces 42 are randomly positioned off the game board 20 so that their first indicia 28 are hidden from view by the players, e.g., by placing all the pieces 42 in an opaque bag or other container. As another example, first playing pieces 42 like those shown in FIG. 5 can be randomly arranged on a flat surface with their upper surfaces 46 turned face down. Such a randomly arranged group of first playing pieces 42 is henceforth referred to as "the pile." Four first playing pieces 42, each displaying a different first indicium 28, are selected from the pile by any of the players and placed in the first quadrant **40*a* of the playing surface 22 at first symbols 24 displaying the correspondingly coded first indicia 28. Any first playing piece 42 displaying a duplicate first indicium 28 is returned to the pile, with its first indicium 28 again hidden from view. Four more first playing pieces 42 are similarly selected by any of the players and correspondingly positioned in the second quadrant 40b. This procedure is repeated until four first playing pieces 42 have been positioned in each of the four quadrants 40*a–d***.

Each player then selects six first playing pieces 42 from the pile and arranges them, e.g., by standing them on their side surfaces 48, so that he or she alone can view the first indicia 28 displayed thereon. Each player also chooses a complete set of second playing pieces 52 that display one of the fourth indicia 56. Each player also receives a random selection of four third playing pieces 62. Any remaining third playing pieces 62 are put aside and not used during the gameplay.

To commence the gameplay, a predetermined starting player positions any one of his or her six first playing pieces 42 at any unoccupied first symbol 24 (in any quadrant **40*a–d*) that displays the correspondingly coded first indicium 28. The starting player then positions one of his or her distinctively coded second playing pieces 52 upon the just-placed first playing piece 42. The same player continues to position his or her second playing pieces 52 on any and all first playing pieces 42 occupying first symbols 24 that share a common boundary 26 with the first playing piece 42 he or she just played, and so on. Second playing pieces 52 may only be placed on first playing pieces 42 that occupy first symbols 24 sharing a common boundary 26, not on diagonally located first playing pieces 42 that do not share a common boundary 26. The player's turn is over when he or she has constructed the longest possible continuous chain of second playing pieces 52**.

Figure 11:
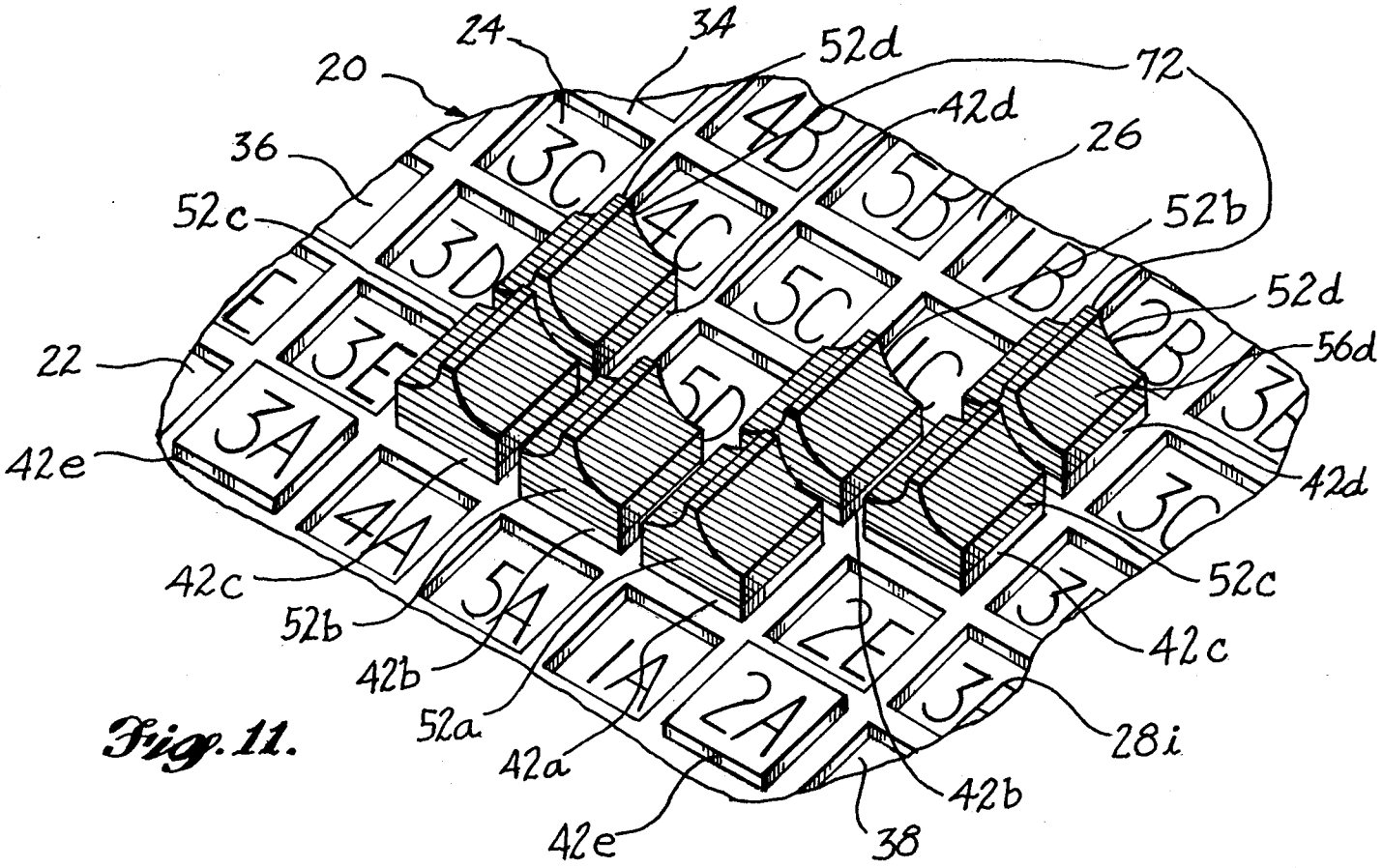
FIG. 11 is a sectional view of the game board as shown in FIG. 4 except showing a chain of first and second playing pieces.

For example, referring to FIG. 11 a chain 72 is shown made up of several first symbols 24: 4D, 4E, 5E, 1E, 1D, 2D, 2C, spanning for illustrative purposes quadrants **40*a* and 40*d* on the game board 20 of FIG. 4. The chain shown in FIG. 11 could arise as follows. If the starting player played first playing piece 42*a* on the first symbol 24 displaying the first indicium 1E, then he or she places one second playing piece 52*a* displaying his or her fourth indicium 56*d* on that first playing piece 42*a*. Next, he or she places one of his or her second playing pieces 52*b* on any first playing piece 42*b* occupying a first sumbol or symbols 24 that share a common boundary 26 with the first symbol 24 occupied by the first playing piece 42*a* he or she played. His or her second playing pieces 52*c* are also positioned on all first playing pieces 42*c* occupying a first symbol that shares a common boundary 26 with the first symbols 24 occupied by the first playing pieces 42*b* just having second playing pieces 52*b* positioned on them. This step is continued until the remaining first playing pieces 42*d* connected in the chain 72 have second playing pieces 52*d*** positioned on them. Play then continues with another player taking a turn.

Eventually one of the players will, by plan or necessity, position a first player piece 42 on a first symbol 24 that shares a common boundary 26 with a first playing piece 42 that bears an opponent's second playing piece 52. The player proceeds to position second playing pieces 52 displaying his or her fourth indicium 56 on any available and unoccupied first playing pieces 44, thereby forming a new chain 72 as described above. Then the player and opponent compare the number of second playing pieces 52 in the abutting chains. The one with the most second playing pieces 52 takes possession of the other's chain 72 by replacing each of the other player's second playing pieces 52 in the chain 72 with one displaying his or her fourth indicium 56. In the event of a tie, where the comparison shows that the abutting chains are of equal value, then the player who placed the connecting first player piece 42 takes possession of the entire chain 72. A similar result occurs, in the case of a three-way chain with three players, where no player can claim a majority of the first playing pieces 42.

Figure 13:
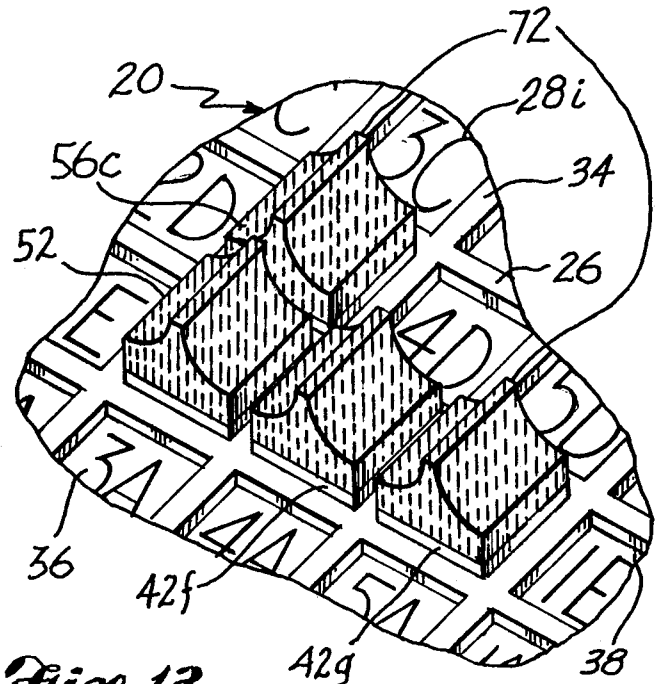
FIG. 13 is a sectional view of the game board as in FIG. 12 except showing the outcome of the play of linking to an existing chain.
Figure 12:
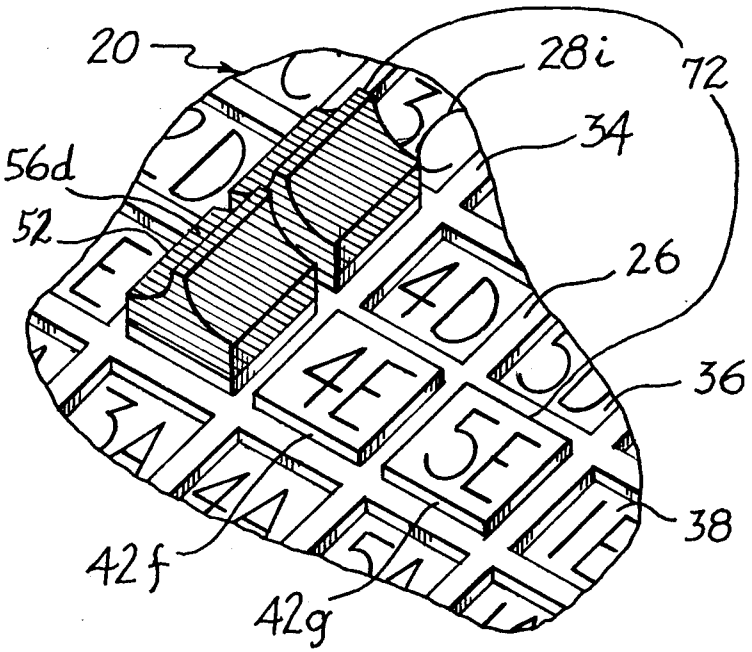
FIG. 12 is a sectional view of the game board as in FIG. 11 except indicating a play that links to an existing chain.

For example, referring to FIG. 12, if he or she played the first playing piece **42*f* on the first symbol 24 displaying the first indicium 4E, then he or she first positions one of his or her second playing pieces 52 on the first playing pieces 42*f*, 42*g* displaying first indicia 4E and 5E**. Then because there was a tie and he or she played the connecting first playing piece 42*f*, he or she replaces the second playing pieces 52 displaying the opponents' fourth indicia 56*d*, as shown in FIG. 13, with ones 52 displaying his or her fourth indicia 56*c*.

A player may elect on any turn to play one of his or her four third playing pieces 62 instead of a first playing piece 42. Third playing pieces 62 may be positioned on any unoccupied first symbol 24. Third playing pieces 62 occupy a first symbol 24 but allow no player, including the placing player, to take possession of that first symbol 24 by placing one of his or her second playing pieces 52 on the third playing piece 62.

Each turn each player must position one first or third playing piece 42, 62 on the playing surface 22 at any unoccupied first symbol 24 that displays a corresponding first indicium 28. Each player starts with six first playing pieces 42 and does not draw a replacement from the pile until he or she has positioned three first playing pieces 42 on the playing surface 22. From then on when a first playing piece 42 is played a replacement first playing piece 42 is drawn from the pile, so that at the end of each turn each player has four first playing pieces 42. Should a player have or draw from the pile a first playing piece 42 for which there is no correspondingly coded, unoccupied first symbol 24 available on the playing surface 22 (due to prior placement of one or more third playing pieces 62), then it is shown to all opponents, put aside, and a replacement is drawn from the pile. No replacement third playing 62 pieces are received. The gameplay continues until one player manages to position all of his or her second playing pieces 52 on the game board 20.

In a related embodiment suitable for younger players the game is played as described above but using the simpler game board 20 shown in FIG. 1 and without third playing pieces 62.

In a strategic embodiment suitable for older players the game is played as described above but increasing the number of third playing pieces 62 each player receives, and using a game board 20 that includes one or more types of second symbols 30. Receiving a greater number of third playing pieces 62 permits greater chain blocking flexibility. The inclusion of second symbols 30 adds a further complexity of having game board locations which have special rules affecting play, such as blocking locations (e.g., displaying a "BLOCK" indicium 32*a*) where no chains 72 can connect, or "FREE" locations 32b that facilitate chain 72 forming.

Figure 14:
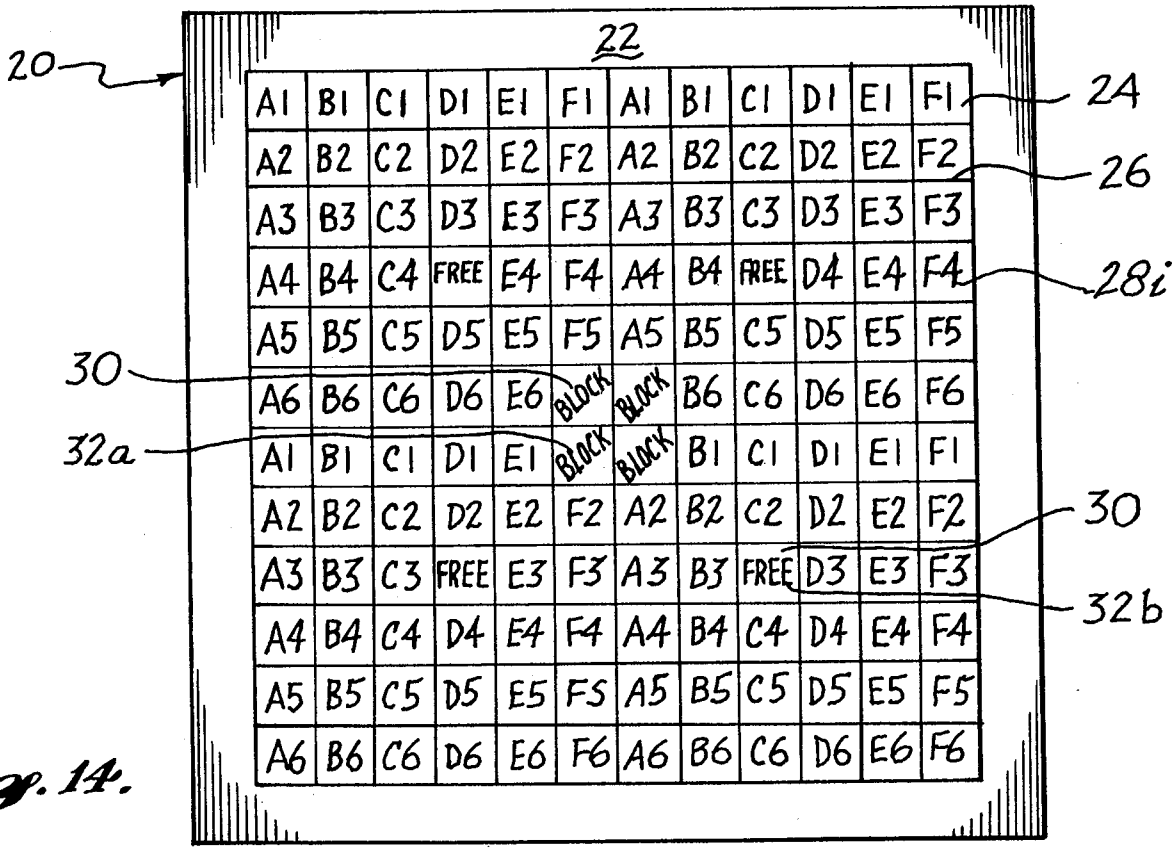
FIG. 14 is a plan view of a game board as in FIG. 4 with a greater number of symbols for play by more players.

A version of any of the embodiments described above suitable for more players can be achieved by increasing the number of first symbols 24 displayed on the playing surface 22 of the game board 20. For example, the game board 20 used in the embodiment shown in FIG. 4, which with one hundred first symbols 24 is considered suitable for two adult players, can be replaced by one such as shown in FIG. 14 with a total of one hundred forty-four symbols 24, 30.

Game rule modifications can also be made to make the game more or less strategic. For example, for younger players the preplay positioning of first playing pieces 42 on the game board 20 may be eliminated. For older players a greater number of first playing pieces 42 may be positioned on the game board 20 during the preplay setup, thereby increasing the initial number of strategic chain 72 forming options. To further increase the strategic dimension of the game play the object may be altered from being the first player to occupy a majority of the first symbols 24, to being the player to possess one chain 72 that occupies a majority of the first symbols 24 on the game board 20.

The game rules are typically provided as printed instructions in combination with the described game board apparatus components.

While the present invention has been described in conjunction with preferred embodiments, one of ordinary skill after reading the foregoing specification will be able to affect various changes, substitutions of equivalents, and other alterations to the board game apparatus and game method set forth herein. The enjoyable game play that is provided by this game apparatus derives from the strategic choices that are provided by the multiplicity of possible interactions of the game apparatus components, particularly by the strategic decisions of selecting from a limited number of options which playing piece to play at which of multiple locations so as to create new chains of connected playing pieces, expand existing chains, interconnect chains, protect chains from capture by opponents, or take over the chains of opponents so as to possess a majority of the first symbols displayed on the playing surface of the game board. Thus, the same game can be played by using the game apparatus in combination as described above but adding a theme such as real estate acquisition, business merger, or even a warfare theme to the abstract motif described in the disclosed embodiment. It is therefore intended that the protection granted by Letters Patent hereon be limited only by the definition contained in the appended claims and equivalents thereof.

The embodiments of the invention in which exclusive property or privilege is claimed are defined as follows:

1. A game apparatus comprising in combination:
   - a game board with a playing surface displaying a plurality of interconnected first symbols, each first symbol displays coded first indicia thereon, each coded first indicia displayed on at least two first symbols;
   - a plurality of first playing pieces with a surface adapted for placement on the playing surface at selected first symbols, each first playing piece correspondingly displaying one of the coded first indicia; and,
   - a plurality of second playing pieces with a surface adapted for placement on any of the first playing pieces, second playing pieces are distinguishable from first playing pieces by the absence of first indicia, at least two types of second playing pieces are distinguishable by the presence of different fourth indicia, the minimum number of second playing pieces provided displaying each distinguishable fourth indicia equals the smallest whole number that is a majority of the total number of first symbols displayed on the playing surface.

2. The apparatus apparauts of claim 1, wherein the first symbols are directly connected on the playing surface.

3. The game apparatus of claim 1, wherein the game board further comprises second symbols that do not display any of the first indicia.

4. The game apparatus of claim 3, wherein at least two of the first symbols are indirectly connected through at least one second symbol.

5. The game apparatus of claim 3 wherein the first and second symbols are also distinguishable one type from the other by coded second indicia.

6. The game apparatus of claim 5 wherein the second indicia comprise words or acronyms.

7. The game apparatus of claim 5 further comprising a plurality of third playing pieces adapted for placement on the playing surface at selected first symbols, third playing pieces are distinguishable from first and second playing pieces by the absence of first and fourth indicia, third playing pieces are further distinguished from first and second playing pieces by displaying a coded fifth indicia and the fifth indicia comprise a code indistinguishable from the coded second indicia.

8. The game apparatus of claim 1 wherein each of the coded first indicia is displayed on the playing surface on at least three first symbols.

9. The game apparatus of claim 8 wherein each of the coded first indicia is displayed on the playing surface at four first symbols.

10. The game apparatus of claim 1, further comprising a plurality of third playing pieces adapted for placement on the playing surface at selected first symbols, third playing pieces are distinguishable from first and second playing pieces by the absence of first and fourth indicia.

11. The game apparatus of claim 10 wherein third playing pieces are further distinguishable from first and second playing pieces by displaying a coded fifth indicia.

12. The game apparatus of claim 10 wherein the number of third playing pieces equals at least three times the number of distinguishable fourth indicia.

13. The game apparatus of claim 11 wherein the fifth indicia comprise color codes.

14. The game apparatus of claim 11 wherein the fifth indicia comprise words or acronyms.

15. The game apparatus of claim 1, wherein each first playing piece has upper and lower surfaces, the lower surface of each first playing piece being adapted for placement on the playing surface at selected first symbols, the upper surface of each first playing piece being adapted for face down placement on a flat surface, and coded first indicia are displayed on the upper surface.

16. The game apparatus of claim 15 wherein the lower surfaces of the first playing pieces are indistinguishable one from another, each first playing piece lower surface is distinguishable from all the first playing piece upper surfaces by the absence of first indicia on the lower surface.

17. The game apparatus of claim 16 wherein the first playing piece lower surfaces display a coded third indicia that further distinguishes them from each of the first playing piece upper surfaces.

18. The game apparatus of claim 17 wherein the coded third indicia comprises a word or acronym.

19. The game apparatus of claim 1 wherein the number of first playing pieces equals the number of first symbols.

20. The game apparatus of claim 19 wherein the number of first playing pieces displaying each coded first indicia equals the number of first symbols correspondingly coded with that same first indicia displayed on the playing surface.

21. The game apparatus of claim 1 wherein each second playing piece has lower and upper surfaces, the lower surface being adapted for placement on any of the first playing pieces, and the upper surface has an apex that is developed into a manipulable handle.

22. The game apparatus of claim 1 wherein the first indicia comprise numeral codes.

23. The game apparatus of claim 1 wherein the first indicia comprise alphanumeric codes.

24. The game apparatus of claim 1 wherein the first indicia comprise a code of at least one color.

25. The game apparatus of claim 1 wherein the first indicia comprise at least one color code in combination with at least one numeral code.

26. The game apparatus of claim 1 wherein the number of distinguishable fourth indicia is at least three.

27. The game apparatus of claim 26 wherein the number of distinguishable fourth indicia is at least four.

28. The game apparatus of claim 1 wherein the fourth indicia comprise color codes.

29. The game apparatus of claim 1 wherein the fourth indicia comprise geometric shape codes.

30. The game apparatus of claim 1 wherein the playing surface is recessed below the top surface of the game board.

31. The game apparatus of claim 30 wherein each first symbol is a recess and each first symbol displays a coded first indicia on the bottom surface of its recess.

32. The game apparatus of claim 31 wherein at least two of the first symbol recesses are connected indirectly by at least one second symbol recess.

33. The game apparatus of claim 1 wherein the first playing pieces have side surfaces adapted for placement on a stand.

34. The game apparatus of claim 1 wherein the first playing pieces have side surfaces adapted for freestanding placement on a flat surface.

35. A method for playing a game comprising in combination.

a game board with a playing surface displaying a plurality of interconnected first symbols, each first symbol displays coded first indicia thereon, each coded first indicia displayed on at least two first symbols;

a plurality of first playing pieces with a surface adapted for placement on the playing surface at selected first symbols, each first playing piece correspondingly displaying one of the coded first indicia;

a plurality of second playing pieces with a surface adapted for placement on any of the first playing pieces, second playing pieces are distinguishable from first playing pieces by the absence of first indicia, at least two types of second playing pieces are distinguishable by the presence of different fourth indicia; and where at least two different players in turn position at least one first playing piece on the game board at a selected first symbol displaying a correspondingly coded first indicia, on the first playing piece is positioned one second playing piece, turns continue until second playing pieces displaying one coded fourth indicia are positioned on first playing pieces at a majority of the first symbols displayed on the playing surface of the game board.

36. The method of claim 35 wherein each player selects a set of second playing pieces displaying a unique fourth indicia.

37. The method of claim 36 wherein if the first playing piece positioned on the playing surface shares a mutual boundary with a first playing piece having on it a second playing piece displaying an opponent's fourth indicia, then a new chain is formed where the player positioning the first playing piece first puts second playing pieces displaying his or her fourth indicia on any first playing pieces in the new chain without second playing pieces on them, then each player counts the number of second playing pieces displaying his or her fourth indicia on first playing pieces in the new chain, the player with the greatest number of first playing pieces in the new chain takes possession of the entire chain by replacing each of the opponents' second playing pieces in the chain with one displaying his or her own fourth indicia, in the event of a tie where no one player possesses the greatest number of first playing pieces then the player positioning the connecting first playing piece takes possession of the entire chain.

38. The method of claim 35 wherein players select first playing pieces with unknown first indicia.

39. The method of claim 38 wherein all of the first playing pieces are positioned inside an object that obscures their first indicia.

40. The method of claim 38 wherein all of the first playing pieces display the coded first indicia only on an upper surface, and the first playing pieces are oriented on a surface so that the upper surfaces are face down.

41. The method of claim 35 wherein each player receives at least one third playing piece, each third playing piece is adapted for placement on the playing surface at selected first symbols and distinguishable from first and second playing pieces by the absence of first and fourth indicia, on any turn a player can play one of his or her third playing pieces instead of a first playing piece, it can be positioned on any unoccupied first symbol and blocks chain formation as it allows no player to place a second playing piece on it and thereby take possession of that first symbol.

42. The method of claim 35 wherein play continues until one chain is formed that occupies a majority of the first symbols displayed on the playing surface of the game board.

43. The method of claim 35 wherein the minimum number of second playing pieces provided displaying each distinguishable fourth indicia equals the smallest whole number that is a majority of the total number of first symbols displayed on the playing surface.

* * * * *